US006250806B1

(12) United States Patent
Beshoory

(10) Patent No.: US 6,250,806 B1
(45) Date of Patent: Jun. 26, 2001

(54) DOWNHOLE OIL-SEALED BEARING PACK ASSEMBLY

(75) Inventor: Edward Joseph Beshoory, Houston, TX (US)

(73) Assignee: Bico Drilling Tools, Inc., Houston, TX (US)

( * ) Notice: Subject to any disclaimer, the term of this patent is extended or adjusted under 35 U.S.C. 154(b) by 0 days.

(21) Appl. No.: 09/377,505

(22) Filed: Aug. 19, 1999

Related U.S. Application Data

(60) Provisional application No. 60/097,858, filed on Aug. 25, 1998.

(51) Int. Cl.[7] ..... E21B 4/02

(52) U.S. Cl. ..... 384/97; 175/107; 277/930

(58) Field of Search ..... 175/107; 384/97, 384/93, 94, 130, 313, 315, 316, 477; 277/930, 527, 571

(56) References Cited

U.S. PATENT DOCUMENTS

| | | | | |
|---|---|---|---|---|
| 2,353,534 | | 7/1944 | Yost | 255/4 |
| 3,659,662 | * | 5/1972 | Dicky | 175/107 |
| 3,807,513 | | 4/1974 | Kern et al. | 175/107 |
| 3,840,080 | | 10/1974 | Berryman | 175/107 |
| 3,857,655 | | 12/1974 | Tschirky | 175/107 |
| 3,866,988 | | 2/1975 | Striegler | 175/92 |
| 3,912,425 | | 10/1975 | Tschirky et al. | 175/107 |
| 4,029,368 | | 6/1977 | Tschirky et al. | 175/371 |
| 4,114,702 | | 9/1978 | Maurer et al. | 175/107 |
| 4,114,703 | | 9/1978 | Matson, Jr. et al. | 175/107 |
| 4,114,704 | | 9/1978 | Maurer et al. | 175/107 |
| 4,284,149 | * | 8/1981 | Fox | 175/107 X |
| 4,340,334 | | 7/1982 | Nixon | 415/172 |
| 4,372,400 | | 2/1983 | Beimgraben | 175/107 |
| 4,476,944 | | 10/1984 | Beimgraben | 175/65 |
| 4,484,753 | | 11/1984 | Kalsi | 277/27 |
| 4,492,276 | | 1/1985 | Kamp | 175/61 |
| 4,546,836 | * | 10/1985 | Dennis et al. | 175/107 |
| 4,560,014 | | 12/1985 | Geczy | 175/107 |

(List continued on next page.)

OTHER PUBLICATIONS

Adam T. Bourgoune Jr. et al., Applied Drilling Engineering, SPE Textbook Series, vol. 2, 1991, pp. 402–410.

*Primary Examiner*—Thomas R. Hannon
(74) *Attorney, Agent, or Firm*—Akin, Gump, Strauss, Hauer & Feld

(57) ABSTRACT

A downhole oil-sealed bearing pack assembly is provided for protecting bearing elements and seals. The bearing pack assembly includes a non-contact flow restrictor for reducing large differential pressures across sealing elements. The non-contact flow restrictor includes an inner restrictive element attached to a rotatable drive shaft and an outer restrictive element secured to a stationary bearing housing. The inner restrictive element can include an outwardly extending ring adjacent to a first land and the outer restrictive element can include an inwardly extending ring adjacent to a second land. During rotation of the drive shaft the inwardly and outwardly extending rings remain a distance from the second and first lands, respectively, thus permitting a fluid to traverse the rings and lands. The invention also provides a wear sleeve for increasing seal and shaft life. The wear sleeve includes a groove cut into a hollow sleeve which is secured to the rotatable driveshaft. A cooling fluid within the groove dissipates heat generated by seals contacting the wear sleeve on the rotating shaft. Further, a piston and dipstick assembly is provided for supplying oil to bearing elements and for measuring oil within a reservoir. The piston and dipstick assembly includes a chamber for containing oil and a drilling fluid. A floating piston applies pressure to the oil in the chamber and prevents the drilling fluid from mixing with the oil. A conduit extending into the chamber permits a dipstick to measure the location of the piston within the chamber to determine the amount of oil remaining within the chamber.

34 Claims, 7 Drawing Sheets

U.S. PATENT DOCUMENTS

| | | | | |
|---|---|---|---|---|
| 4,593,774 | | 6/1986 | Lingafelter | 175/107 |
| 4,679,638 | | 7/1987 | Eppink | 175/107 |
| 4,811,597 | | 3/1989 | Hebel | 73/151 |
| 5,048,981 | * | 9/1991 | Ide | 175/107 X |
| 5,067,874 | | 11/1991 | Foote | 415/230 |
| 5,069,298 | * | 12/1991 | Titus | 175/107 |
| 5,082,294 | * | 1/1992 | Toth et al. | 277/930 X |
| 5,096,004 | | 3/1992 | Ide | 418/48 |
| 5,163,521 | | 11/1992 | Pustanyk et al. | 175/40 |
| 5,195,754 | | 3/1993 | Dietle | 277/27 |
| 5,248,204 | | 9/1993 | Livingston et al. | 384/97 |
| 5,385,407 | | 1/1995 | De Lucia | 384/97 |
| 5,518,379 | | 5/1996 | Harris et al. | 418/11 |
| 5,690,434 | | 11/1997 | Beshoory et al. | 175/107 |
| 5,817,937 | | 10/1998 | Beshoory et al. | 73/152.46 |

* cited by examiner

DOWNHOLE OIL-SEALED BEARING PACK ASSEMBLY

CROSS-REFERENCE TO RELATED APPLICATIONS

This application claims priority from provisional patent application Ser. No. 60/097,858, filed Aug. 25, 1998.

BACKGROUND OF THE INVENTION

1. Field of the Invention

The present invention relates generally to bearing assemblies for a drilling motor. In particular, the present invention relates to downhole oil-sealed bearing pack assemblies for a drilling motor.

2. Description of the Related Art

In the oil and gas industry, as well as in mining and other industries, holes are often drilled into the earth to reach the desired stratum to evacuate natural resources. To drill deep holes, the practice of using a fluid motor to drive a drill bit has become commonplace. In operation, the fluid motor is installed at the lower end of a drill pipe string and drilling fluid or mud is circulated down through the drill string and motor. The drilling mud flowing through the motor causes a mounted driveshaft to rotate. A drill bit, which contains nozzles, is secured to the end of the drive shaft and rotates to cut through the formation or stratum. Simultaneously, the drilling mud passes through the bit nozzles to flush away the cuttings. Once the drilling mud has exited the nozzles, the mud and cuttings return to the drilling rig or surface through the annulus created between the outside of the drill pipe string and the borehole.

During well drilling operations, the drill bit is forced against the earth's formation by the weight of the drill string. The weight of the drill string is transferred through a rotatable bearing assembly to a hollow drive shaft which is attached to the drill bit. In general, the drive shaft is driven or rotated by the rotor of the fluid motor. A bearing housing, containing the rotatable bearing assembly and through which the drive shaft extends, remains relatively stationary. As a result of this drilling method, the rotatable bearing assembly must endure severe vibration, shock, and axial and radial loading.

Typically, fluid motor bearing assemblies include a combination of bearing elements, such as radial bearings and thrust bearings. The rotation of the drive shaft within the bearing assembly creates a substantial amount of heat within the individual bearing elements. As a result, the bearing elements must be cooled by some type of lubricant.

In the past, one technique for cooling the bearing assemblies was by allowing a small portion of the drilling mud to circulate through the bearing elements. A portion of the drilling mud in the drill string was diverted from the hollow drive shaft to the bearing assembly. Although this method of cooling was effective, it had the disadvantage of introducing the polished bearing elements to abrasive particles, such as mud, grit and formation cuttings. The abrasive particles caused excessive wear on the bearings and reduced their effectiveness and life expectancy. Another disadvantage with mud cooled or lubed thrust bearings was the necessity of spherical rolling elements, as opposed to cylindrical rolling elements, due to grit and debris in the mud. The presence of grit in the mud causes cylindrical rolling elements to slide, rather than roll. A disadvantage with mud cooled thrust bearings with spherical rolling elements was that spherical rolling elements have a lower load capacity than cylindrical rolling elements.

By contrast, other prior art fluid motor bearing assemblies were cooled by an oil or grease type lubricant. The oil-sealed bearing assemblies were sealed at opposite ends of an annular bearing chamber existing between the drive shaft and the bearing housing. Seals were necessary to prevent drilling mud from entering into the oil-filled bearing chamber from the mud-filled drill string. Sealing this system, however, was difficult because the pressure of the drilling mud within the drill string and drill motor was often 2,000 pounds per square inch (psi) greater than the drilling mud pressure after exiting the nozzles of the drill bit. Thus, the disadvantage of this system was that for the seals to protect the oil-filled bearing chamber from drilling mud, the seals needed to be able to seal the 2,000 psi differential across the seal. As a result, the life expectancy of these seals was very low and failures occurred frequently.

Another method of sealing drilling mud from the oil-filled bearing chamber was to employ a low pressure seal and create a hydraulic pressure drop within the drill motor such that the low pressure seal only needed to seal a pressure differential of a few pounds per square inch. A mechanical face seal or flow restrictor was used to reduce the pressure near the bearing chamber seals to approximately the pressure found within the borehole annulus between the borehole and the drill string. The mechanical face seal permitted drilling mud to flow from the drill string out to the borehole annulus. The mechanical face seal included two mating surfaces that were in sliding contact during drilling operations. One of the mating surfaces was secured to the stationary bearing housing and the second mating surface was attached to the rotating drive shaft. Drilling mud would leak between the two contacting surfaces causing a gradual pressure drop from the high pressure of the drill string to the low pressure of the borehole annulus. The disadvantage of this system included wear of the mating surfaces due to their sliding contact. Another disadvantage was that the fluid which leaked across the mechanical face seal needed to be nonabrasive to minimize the erosion of the mating surfaces.

Oil-sealed bearing assemblies, like those described above, typically used seals that contacted the surface of the rotating drive shaft. Usually, the seals were made from an elastomeric material. Because the seals were in contact with the rotating drive shaft, the drive shaft was coated with a special coating to reduce wear on the contact surface.

Coating the drive shaft has several disadvantages. For example, since the drive shaft is often under severe bending and torsional loading conditions during operation, applying any type of coating to the drive shaft reduces the shaft's fatigue life and increases the probability of fatigue failure. Another disadvantage of coating the drive shaft manifests itself when the coating becomes worn and the drive shaft must be taken out of service to be recoated. During the period of time in which recoating occurs, another expensive drive shaft is required to put the apparatus back into operation. Thus, an operator would need an inventory of expensive replacement drive shafts to drill with a coated drive shaft.

Alternatively, some oil-sealed bearing assemblies attached a wear sleeve to the drive shaft. The wear sleeve was fit onto the drive shaft and the seals contacted the wear sleeve rather than the actual drive shaft. The disadvantage of this system was the excessive heat generated at the seal and wear sleeve interface which caused the seals to overheat and fail. This excessive heat did not usually occur in the drive shaft/seal combination because the circulating mud within the bore of the drive shaft dissipated the heat at this interface.

Typically, an oil-sealed bearing assembly included an oil reservoir and a floating piston on top of the reservoir to pressure compensate between the lubricating oil and the drilling mud. Additionally, the floating piston included a seal and a roller bearing which contacted the rotating drive shaft. Because the piston floated on top of the oil reservoir, it permitted the oil to thermally expand within the reservoir while simultaneously providing pressure to the oil within the reservoir to compensate for any oil loss across the seals.

A disadvantage of the floating piston was its tendency to bind between the drive shaft and the bearing housing as the drive shaft bent in response to side loadings. Another disadvantage included the roller bearing scarring the surface of the rotating drive shaft in the area which the seals contacted the drive shaft. Yet another disadvantage of this system included the absence of a means for checking the oil level within the reservoir while out on a rig or platform.

An oil-sealed bearing pack assembly is desired to overcome the disadvantages of the pack assembly described above. Such a bearing pack assembly should reduce the differential pressure across upper and lower seals of the bearing pack. Further, it should reduce the wear on the shaft. Additionally, the bearing pack assembly should provide a means for easily checking the oil reservoir level.

SUMMARY OF THE INVENTIONS

The oil-sealed bearing pack assembly of the present invention is intended for use in a variety of drill motor assemblies and various rotor and stator designs. The oil-sealed bearing pack assembly provides a non-contact flow restrictor device for eliminating large differential pressures across upper and lower seals of the bearing pack assembly. The non-contact flow restrictor includes an inner restrictive element attached to a rotatable drive shaft and an outer restrictive element secured to a stationary bearing housing. The inner restrictive element can include an outwardly extending ring adjacent to a first land and the outer restrictive element can include an inwardly extending ring adjacent to a second land. During rotation of the drive shaft the inwardly and outwardly extending rings remain a distance from the second and first lands, respectively, thus permitting a fluid to traverse the rings and lands. The non-contact flow restrictor device eliminates the large differential pressures which occur across upper and lower seals.

Additionally, the bearing pack assembly of the present invention includes a wear sleeve for handling the wear on the upper and lower seals. The wear sleeve also protects the drive shaft from unnecessary wear. The wear sleeve includes a groove cut into a hollow sleeve which is secured to the rotatable drive shaft. A thermally conductive fluid within the groove conducts heat generated by the seals from the wear sleeve to the shaft.

The bearing pack assembly of the present invention also provides a convenient means for determining the amount of oil remaining in the oil reservoir. A floating piston and dipstick assembly allows an operator to measure the remaining oil without having to disassemble the bearing pack assembly. The piston and dipstick assembly includes a chamber for containing oil and a drilling fluid. A floating piston applies pressure to the oil in the chamber and prevents the drilling fluid from mixing with the oil. A conduit extending into the chamber permits a dipstick to measure the location of the piston within the chamber to determine the amount of oil remaining within the chamber.

BRIEF DESCRIPTION OF THE DRAWINGS

In order to more fully understand the drawings referred to in the detailed description of the present invention, a brief description of each drawing is presented, in which.

DETAILED DESCRIPTION OF INVENTION

Figure 1:
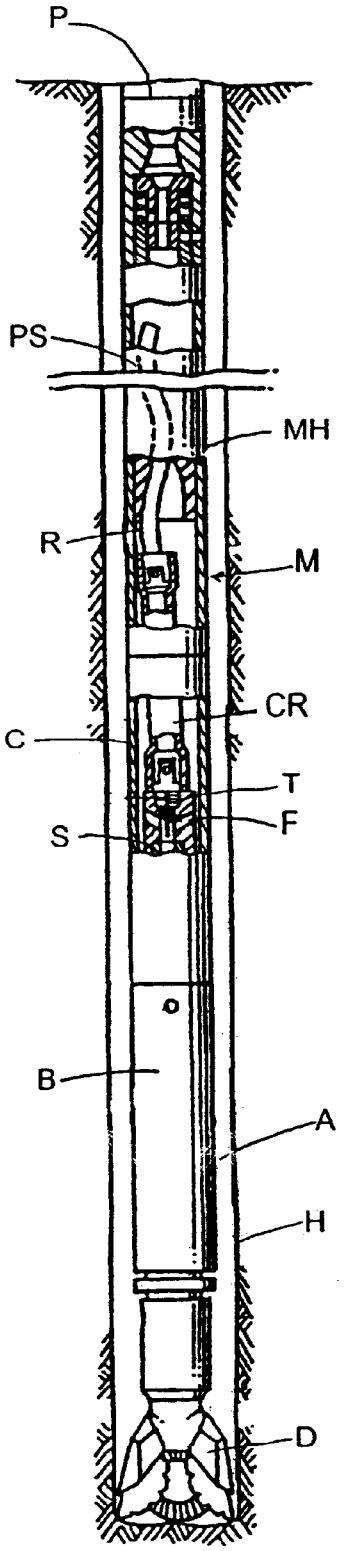
FIGURE 1 (PRIOR ART)
FIG. 1 is an elevational view showing a prior art downhole fluid motor and drill assembly in a borehole.

FIG. 1 shows a typical prior art downhole fluid motor M and drill assembly within a borehole H. During operation of the fluid motor M, drilling fluid or mud is circulated downwardly through a drill pipe string P through the power section PS into a connector rod housing C containing a connector rod CR. The connector rod housing C is secured to a relatively stationary motor housing MH and the connector rod CR is connected to a motor rotor R. The connector rod housing C is attached, often via a threaded connector, to an upper end of a bearing housing B. A rotatable hollow drive shaft S is secured within the bearing housing B. The drive shaft S extends downwardly through a lower end of the bearing housing B and connects to a drill bit D. At its upper end, the drive shaft S is attached to the connector rod CR by a drive shaft cap T.

The drive shaft cap T includes radial fluid passages F which provide fluid communication between the interior of the connector rod housing C and the bore of the hollow drive shaft S. The hollow drive shaft S permits the flow of drilling mud from the interior of the connector rod housing C to the drill bit D. The drilling fluid is discharged through nozzles or orifices in the drill bit D to flush away cuttings from the bottom of the borehole H. The drilling mud travels upwardly to the surface through an annular space A between the borehole H and the outside of the fluid motor M.

An oil-sealed bearing pack assembly 100 according to the present invention is shown in FIGS. 2–13. The oil-sealed bearing pack assembly 100 is intended for use in a drill motor assembly M'. The oil-sealed bearing pack assembly 100 is situated at the lower end of the drill motor assembly M'. It is to be understood that the oil-sealed bearing pack assembly 100 can be used with a variety of drill motor assemblies and various rotor and stator designs.

As will be discussed below, the oil-sealed bearing pack assembly 100 provides a non-contact flow restrictor device for eliminating large differential pressures across seals which prevent drilling mud from mixing with the lubricating oil. Additionally, the oil-sealed bearing pack assembly 100 seals the oil within a bearing housing to protect the individual bearing elements, such as radial bearings and thrust bearings. Further, the present invention includes a floating piston and dipstick for measuring the oil level within the oil-sealed bearing pack assembly 100.

Figure 2A:
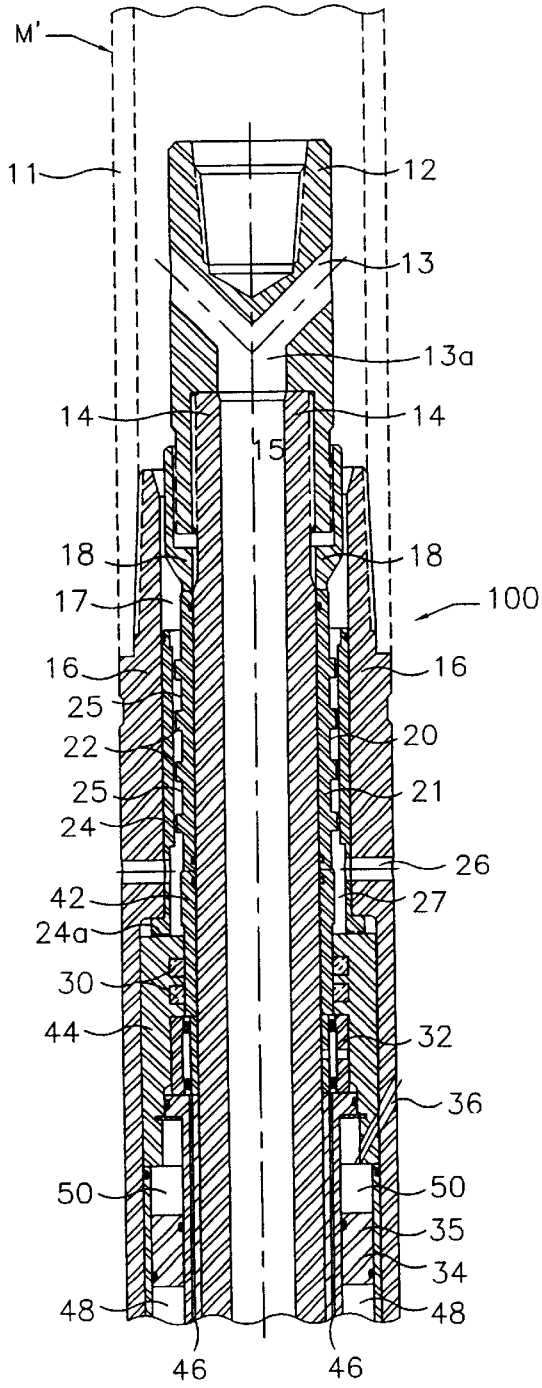
FIGS. 2A and 2B are fragmentary vertical sectional views of a downhole oil-sealed bearing pack assembly of the present invention.
Figure 2B:
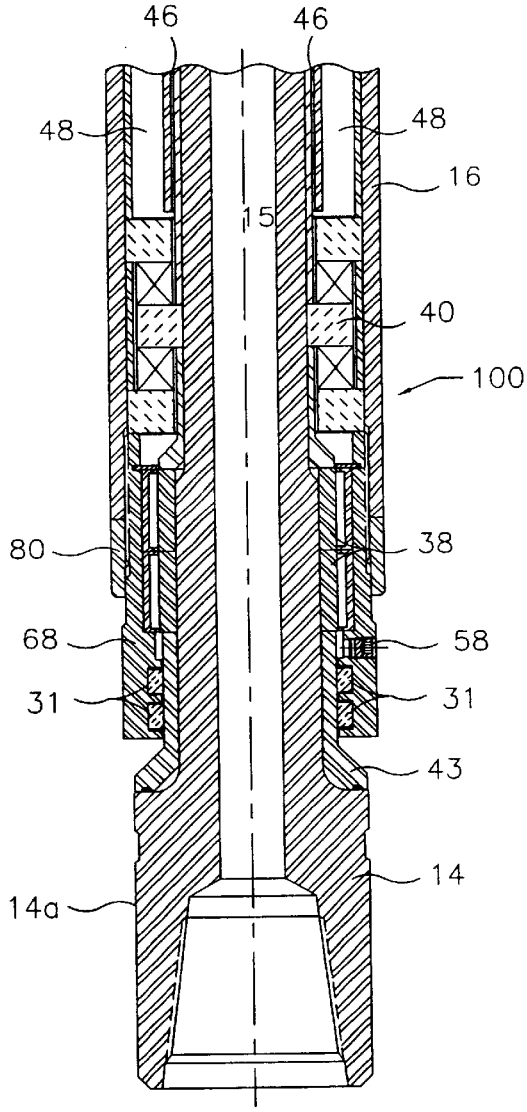

Referring to FIGS. 2A and 2B, the oil-sealed bearing pack assembly 100 includes an outer cylindrical bearing housing 16 and a longitudinal, central drive shaft 14 having an internal fluid passage 15 extending therethrough. The drive shaft 14 includes an enlarged lower end 14*a* adapted for mounting a drill bit thereto. The upper end of the drive shaft 14 is connected, preferably via a threaded connection, to a drive shaft cap 12. The drive shaft cap 12 includes one or more angled radial fluid passages 13 which intersect centrally with an internal fluid passage 13*a* in the drive shaft cap 12 as shown in FIG. 2A. The drive shaft cap internal fluid passage 13*a* is in axial fluid communication with the drive shaft axial fluid passage 15.

It is to be understood that the drive shaft 14 rotates within the bearing housing 16 during operation of the drill motor assembly M'. The upper end of the bearing housing 16 is connected to a connector housing 11 shown in dashed lines in FIG. 2A. Drilling mud fills and flows through the annular space between the connector housing 11 and the drive shaft cap 12. As discussed generally above, the drilling mud or fluid is forced into the radial fluid passages 13 and the internal fluid passages 13*a* and 15 down through the drill bit nozzles (FIG. 1).

It is also to be understood that a portion of the drilling mud is forced through a restrictor passage 17 between the upper end of the bearing housing 16 and the drive shaft 14 as shown in FIG. 2A. The pressure of the drilling mud within the connector housing 11 is approximately the same as the pressure of the drilling mud prior to exiting the nozzles of the drill bit. Depending on the type of drill bit being used, the differential pressure of the drilling mud prior to exiting the drill bit versus after exiting the drill bit is typically in the range of approximately 500 to 2,000 psi.

Figure 13:
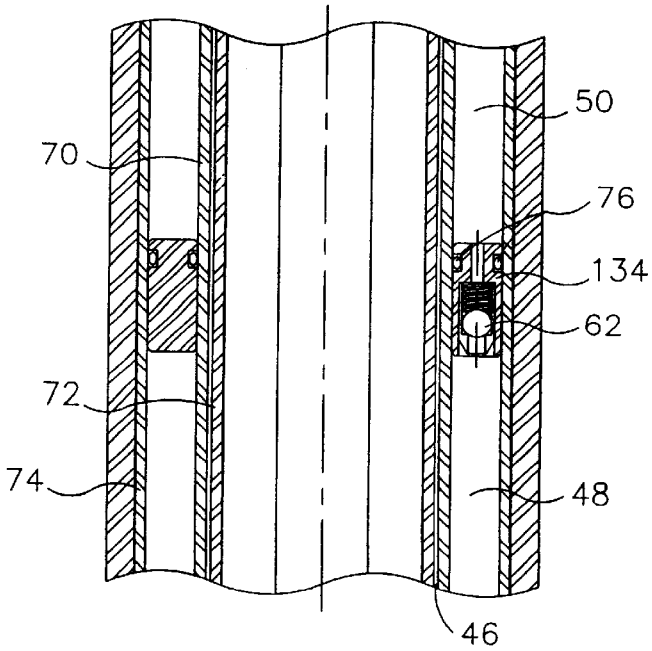
FIG. 13 is a fragmentary sectional view of the present invention showing a piston check valve.

Referring to FIGS. 2A, 2B and 13, the bearing housing 16 includes an upper radial bearing 32, a lower radial bearing 38, a thrust bearing assembly 40, and an oil reservoir 48 for providing lubricant to all of the bearings 32, 38, 40. In the preferred embodiment of the present invention, the upper radial bearing 32 is located within a bearing cartridge 44 having a pair of upper seals 30 forming a seal with an upper cooled wear sleeve 42 as shown in FIGS. 2A and 13. Preferably, the bearing cartridge 44 is a non-floating assembly.

Referring to FIG. 2B, a seal housing 68 having a pair of lower seals 31 is connected to the lower end of the bearing housing 16. The pair of lower seals 31 forms a seal with a lower cooled wear sleeve 43. The seal housing 68 preferably connects to the bearing housing 16 with a threaded connection.

Referring to FIGS. 2A and 2B, the pairs of upper and lower seals 30 and 31, respectively, are preferably lip, chevron type seals, or Kalsi Seals® manufactured by Kalsi Engineering of Sugarland, Tex. The upper seals 30 in the bearing cartridge 44 and the lower seals 31 in the seal housing 68 prevent drilling mud from entering the oil containing portion of the bearing housing 16. If the seals 30 and 31 fail, the bearings 32, 38, 40 and the oil reservoir 48 will become contaminated with drilling mud. The introduction of drilling mud to the bearings 32, 38, 40 would result in additional wear with the bearings heating up due to friction and possibly seizing up.

Figure 3:
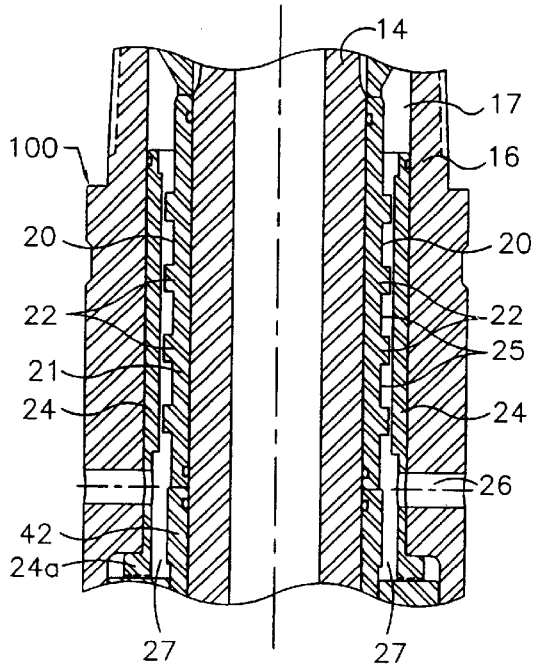
FIG. 3 is a fragmentary sectional view of the present invention showing a flow restrictor.

As shown in FIGS. 2A, 2B and 3, the oil-sealed bearing pack assembly 100 of the present invention includes a non-contact flow restrictor assembly 20 for reducing the pressure differential across the pairs of upper and lower seals 30 and 31, respectively, as will be explained below. In the preferred embodiment, the flow restrictor assembly 20 is located above the bearing cartridge 44 as shown in FIG. 2A.

The flow restrictor assembly 20 includes an inner restrictive element 21 attached to the rotating drive shaft 14 and an outer restrictive element 24 secured to the bearing housing 16. As will be further explained below, the inner restrictive element 21 rotates with the drive shaft 14 and the outer restrictive element 24 remains stationary with the bearing housing 16.

In the preferred embodiment as shown in FIGS. 2A and 3, the inner restrictive element 21 is a sleeve-like member having a plurality of outwardly extending circumferential rings 22 separated by a plurality of lands 25. Preferably, the inner restrictive element 21 is constructed of a single piece of erosion resistant material, such as tungsten carbide. The outer restrictive element 24 is a sleeve member having an inside diameter slightly greater than the outside diameter of the flow restrictor rings 22 as shown in FIG. 3, and is preferably made from an erosion resistant material, such as tungsten carbide. Although not shown, one can appreciate that the rings 22 and the lands 25 could be part of the outer restrictive element 24 and the inner restrictive element 21 could be a sleeve without any rings and lands.

Preferably, the gap between the flow restrictor rings 22 and the outer restrictive element 24 decreases towards the lower end of the flow restrictor assembly 20. For example, the gap between the uppermost ring 22 and outer restrictive element 24 may be approximately 0.012 inches, whereas the lowermost gap may be approximately 0.007 inches. Typically, the distance between a restrictor land 25 and the outer restrictor element 24 is about 0.163 inches. The reason for having a larger gap at the upper end of the flow restrictor assembly 20 is due to the greater deflection experienced by the drive shaft 14 at its upper end. The deflection of the drive shaft 14 is smaller as it approaches the bearing cartridge 44. Although a minimum gap of approximately 0.007 inches exists between the flow restrictor rings 22 and the outer restrictive element 24, the inner and outer restrictive elements 21 and 24, respectively, never come in contact with one another. This results in a long lasting flow restrictor assembly 20 that experiences slow wear.

The size of the gaps within the flow restrictor assembly 20 has an effect on the amount of drilling mud that will be diverted from the internal fluid passage 15 to pass instead through the flow restrictor assembly 20. As shown in FIGS. 2A and 3, the drilling mud passing through the flow restrictor assembly 20 exits through one or more bearing housing openings 26 located above the bearing cartridge 44. Preferably, the vast majority of the drilling mud passes through the internal fluid passage 15 and exits through the drill bit, whereas only a small portion of the drilling mud is diverted through the flow restrictor assembly 20. In the preferred embodiment of the present invention, approximately 1–5% of the drilling mud passes through the flow restrictor assembly 20.

As the drilling mud passes over each flow restrictor ring 22, the drilling mud experiences a significant pressure drop because the mud changes directions and seeps past the rings 22 into a larger cavity defined by the outer restrictive element 24 and a restrictor land 25. Because of the flow restrictor assembly 20, the pressure of the drilling mud at the lower end of the flow restrictor assembly 20 is essentially the same pressure as the drilling mud in the annular space A (FIG. 1) outside the bearing housing openings 26. As will be further explained below, by reducing the drilling mud pressure at the upper side of the seals 30 to essentially the pressure found within the annular space A (FIG. 1) and eliminating any pressure differential, the effectiveness and life of the seals 30 and 31 is greatly enhanced.

Without the flow restrictor assembly 20 of the present invention, the pressure differential across the seals 30 and 31 is large because the seals are exposed directly to the mud pressure differential existing between the drill string and the annular space A in the borehole. As discussed above, the pressure of the drilling mud within the connector housing 11 is approximately the same as the pressure of the drilling mud prior to exiting the nozzles of the drill bit. This causes large differential pressure to act on the seals 30, sometimes reaching as great as 2000 psi. The non-contact flow restrictor assembly 20 of the present invention, however, decreases the pressure differential which the seals 30 and 31 must withstand to almost zero.

In operation, the high pressure drilling fluid or mud enters the flow restrictor assembly 20 from the connector housing 11 at the restrictor passage 17 and continues downwardly between the inner and outer restrictive elements 21 and 24, respectively. As the fluid enters the flow restrictor assembly 20, it encounters the fluid restrictor rings 22 on the inner restrictive element 21.

After the drilling mud has traversed the fluid restrictor rings 22 and lands 25, it either exits through an opening 26 into the annulus A (FIG. 1) or pools in a reservoir 27. At this point, the drilling mud within the opening 26 and reservoir 27 is at approximately the same pressure as the drilling mud within annulus A (FIG. 1) because the drilling fluid which has exited the drill bit nozzles has circulated back up and past the flow restrictor opening 26 to the surface. As a result of the drilling mud flowing through the flow restrictor assembly 20, the seals 30 and 31 only need to seal a differential pressure of about 1 or 2 psi. Moreover, because the inner and outer restrictive elements 21 and 24 never come in contact with one another, the flow restrictor 20 does not experience any wear due to sliding contact.

Figure 4:
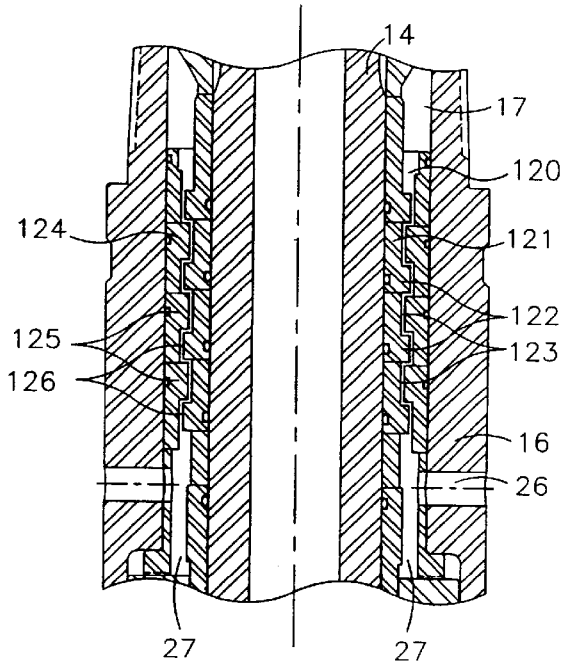
FIG. 4 is a fragmentary sectional view of an alternative embodiment of the flow restrictor.

FIG. 4 shows an alternative embodiment of a flow restrictor assembly 120. As described above, drilling mud enters the flow restrictor assembly 120 at the restrictor passage 17 and mud flows in a labyrinth fashion over an inner restrictive element 121 and an outer restrictive element 124. The inner restrictive element 121 secures to the rotating drive shaft 14 and includes rings 122 and lands 123. By contrast, the outer restrictive element 124 attaches to the stationary bearing housing 16 and includes rings 125 and lands 126. As the drilling mud passes through the flow restrictor's 120 labyrinth of lands and rings, the drilling mud pressure decreases to almost annular pressure as it exits through opening 26 and into annulus A.

As shown, the inner restrictive element 121 and the outer restrictive element 124 are constructed from several individual components of rings and lands. Thus, individual components of the inner and outer restrictive elements can be removed if damaged or worn without removing the entire inner and outer restrictive elements. Preferably, the flow restrictor assembly 120 is made of erosion resistant material.

Figure 5:
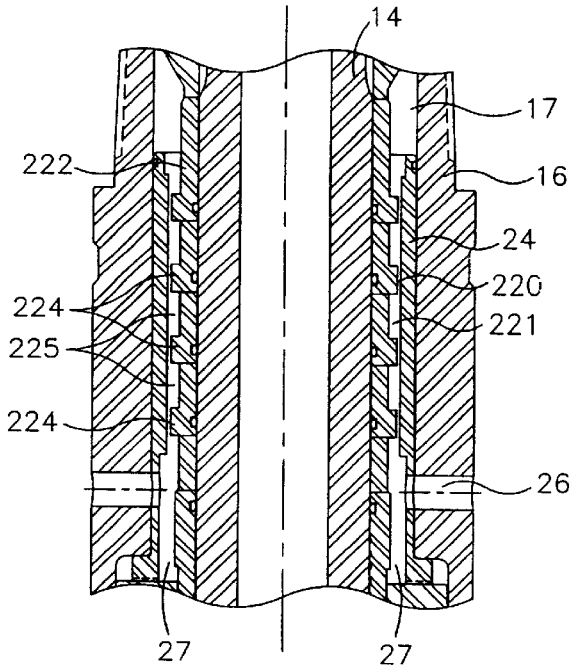
FIG. 5 is a fragmentary sectional view of another alternative embodiment of the flow restrictor.
Figure 6:
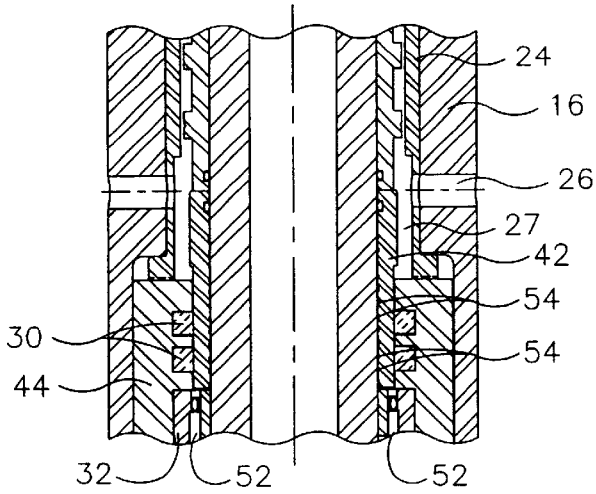
FIG. 6 is an enlarged fragmentary sectional view of the lower portion of an upper thermally conductive wear sleeve.
Figure 7:
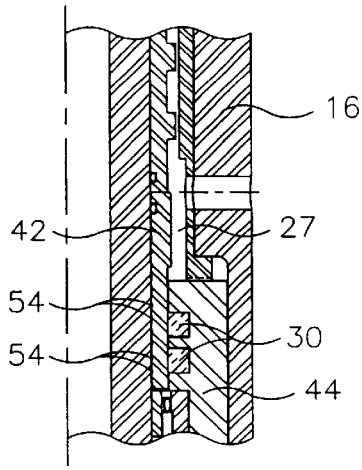
FIG. 7 is an enlarged fragmentary sectional view of the thermally conductive wear sleeve shown in FIG. 6.

A second alternative embodiment of a flow restrictor assembly 220 is shown in FIG. 5. The flow restrictor assembly 220 is similar in operation to the flow restrictor assembly 20 of FIG. 3 but the alternative flow restrictor assembly 220 is constructed slightly different. The outer restrictive element 24 is the same as that described for the preferred embodiment of flow restrictor assembly 20 but the inner restrictive element 221 includes individual restrictive parts 224 that include rings 222 and lands 225. The individual restrictive parts 224 are mounted to the rotating drive shaft 14 whereas the outer restrictive element 24 is attached to the stationary bearing housing 16. Because the inner restrictive element 221 of the flow restrictor 220 is made from individual restrictive parts 224, the parts can be removed and replaced without the need for replacing the entire inner restrictive element 221.

Referring to FIG. 2A, the sealed bearing pack assembly 100 of the present invention also includes a cooled wear sleeve 42 for protecting the drive shaft 14 from wear caused by the abrasive elastomeric seals 30 rubbing against the rotating drive shaft 14. The cooled wear sleeve 42 secures to the drive shaft 14 such that the seals 30 ride against the wear sleeve 42, not the drive shaft 14. In the past, sealing elements, such as the elastomeric seals 30, directly contacted a coated drive shaft. Typically, the coating wore off the drive shaft after about 400 hours of drilling operations. Once the coating and drive shaft were worn the drive shaft either had to be replaced completely or recoated. In either case, because the drive shaft was removed from service the operator needed a large inventory of drive shafts to continuously drill. Retaining an inventory of drive shafts is expensive because drive shafts are typically made from a very expensive forged steel. Further, replacing the coated wear sleeve 42 is far less involved than replacing the drive shaft.

As shown in FIGS. 2A, 6, 7, and 9, the cooled wear sleeve 42 includes internal grooves 54 (FIG. 9) cut into the inside diameter of the wear sleeve 42. Preferably, the wear sleeve 42 is closely fitted onto the drive shaft 14 to minimize any air gaps between the two parts. Additionally, a portion of the wear sleeve 42 can be part of an inner wall of the reservoir 27. Preferably, the wear sleeve 42 is made from a material with better heat conducting properties than the drive shaft such as an alloy steel or copper-beryllium.

The grooves 54 contain oil which conduct away heat generated from the seals 30 contacting the rotating wear sleeve 42. A disadvantage of using a non-cooled wear sleeve on the drive shaft was that a great deal of heat generated between the wear sleeve and the seals due to friction could not be conducted away. In fact, the heat generated could be so great that unless the heat was conducted away, the seals would burn up rather quickly. Without the wear sleeve, the mud flowing through the internal passage of the drive shaft cooled the seals but the drive shaft became scored by the seals. In the present invention, the seals 30 stay sufficiently cool during operation such that contact with the rotating wear sleeve 42 does not retain a significant amount of frictional heat. Thus, the oil within grooves 54 permits the seals 30 to last a significantly longer period than seals in contact with a non-cooled wear sleeve.

As the seals 30 wear against the cooled wear sleeve 42, the cooled wear sleeve 42 experiences wear from the seals 30 but protects the expensive drive shaft 14. As a result, when the seals 30 and wear sleeve 42 are no longer effective in sealing the mud from the oil in the bearing housing 16, the wear sleeve 42 and/or the seals 30 can be removed and replaced with new ones. As can be appreciated, replacing the cooled wear sleeve 42 is far less costly and time consuming than repairing or replacing an expensive worn drive shaft 14.

Figure 8:
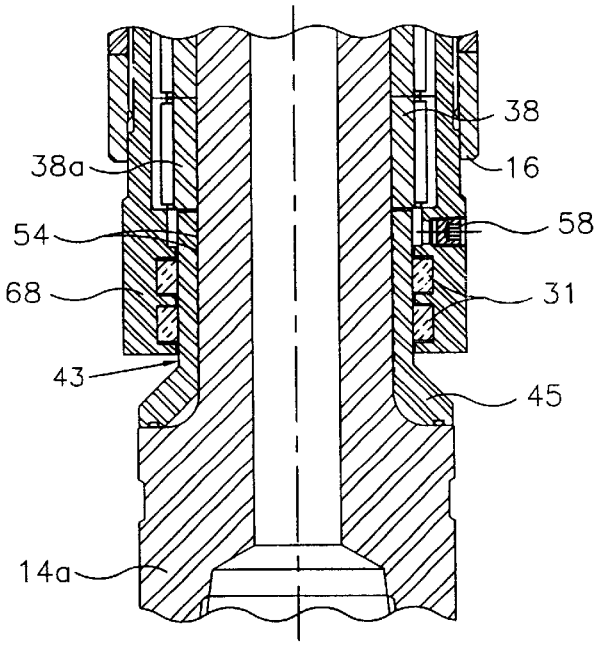
FIG. 8 is an enlarged fragmentary sectional view of the present invention showing a lower thermally conductive wear sleeve.
Figure 9:
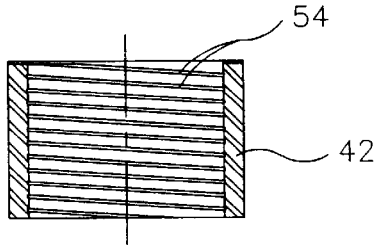
FIG. 9 is an enlarged sectional view of the thermally conductive wear sleeve of FIG. 6.

As shown in FIGS. 2B and 8, the present invention also includes a lower wear sleeve 43 located at the bottom of bearing housing 16. The lower wear sleeve 43 operates in a similar manner to wear sleeve 42 and can be of similar construction. As with cooled wear sleeve 42, the lower cooled wear sleeve 43 includes oil within the grooves 54 to provide a means for cooling the seals 31. As shown in FIG. 8, however, the lower cooled wear sleeve 43 includes the addition of a cooling upset 45 which aids in the conducting away of frictional heat created by the seals 31 contacting the rotating wear sleeve 43. Like seals 30, seals 31 prevent mud from entering into the oil contained within the bearing housing 16. The cooling upset 45 provides an additional means of conducting away heat from the seals 31 because the drilling mud within annulus A surrounds the cooling upset 45 and lowers the temperature of the wear sleeve 43.

Figure 10:
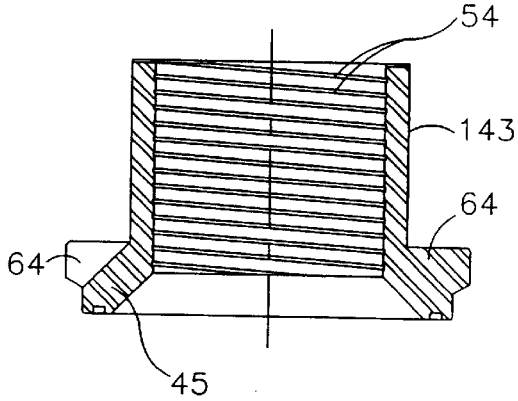
FIG. 10 is a sectional view of an alternative embodiment of the thermally conductive wear sleeve.

An alternative embodiment of the cooled wear sleeve is shown in FIG. 10. An alternative cooled wear sleeve 143 operates in a similar manner to the previously discussed wear sleeves. The wear sleeve 143 is fitted onto the rotating drive shaft 14 and oil fills the grooves 54. The cooled wear sleeve 143, however, includes additional cooling fins 64 which provide a greater surface area for the drilling mud to conduct away the heat generated by the seals 30 and 31 and the rotating drive shaft 14. As can be appreciated, the cooling fins 64 and the cooling upset 45 of the wear sleeve 143 could be positioned within reservoir 27 such that the drilling mud cools the wear sleeve.

Figure 11:
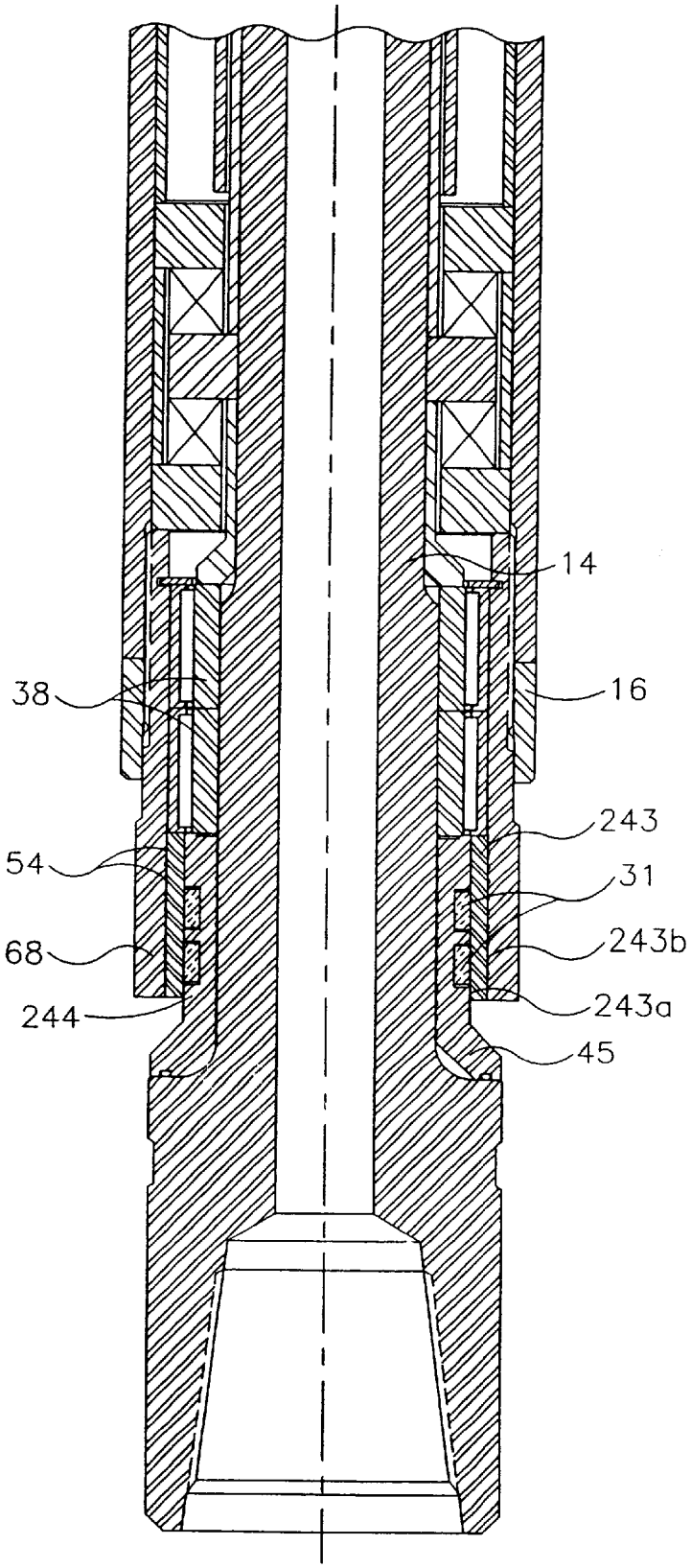
FIG. 11 is a sectional view of an alternative embodiment of the thermally conductive wear sleeve.

Another alternative embodiment of the cooled wear sleeve is shown in FIG. 11. An alternative cooled wear sleeve 243 operates in a similar manner to the previously discussed wear sleeves 42, 43 and 143, but the cooled wear sleeve 243 is secured within the stationary seal housing 68 and does not rotate with the shaft 14. Rather, in this embodiment, a seal sleeve 244 containing the seals 31 is secured to the rotary drive shaft 14. The seals 31 rotate with the shaft 14 and contact an internal surface 243*a* of the wear sleeve 243, thus preventing mud from entering into the oil contained within the bearing housing 16. As the seals 31 contact the internal surface 243*a* of the wear sleeve 243, heat is generated in the seals 31 and the wear sleeve 243. An external surface 243*b* of the wear sleeve 243, however, includes grooves 54 for receiving oil to conduct away the frictional heat created by the seals 31 contacting the wear sleeve 243.

It is to be understood that the grooves 54 in the cooled wear sleeves 42, 43, 143, and 243 are shown as spiral grooves although the grooves 54 can also be of a variety of geometries and configurations. For example, the grooves 54 can be straight grooves, diagonal grooves, or criss-cross grooves to name a few. Moreover, the grooves 54 can extend the length of the cooled wear sleeves but in the preferred embodiment the grooves 54 stop short of one end. Also, the grooves 54 can be non-continuous from one end to the other. Typically, the depth of the grooves is about 0.04 inches.

As can be appreciated, the cooled wear sleeve 42 of the present invention can be used with a variety of seal assemblies. For example, the cooled wear sleeve could be used with equipment such as MWD tools, rotary steerable tools, drill bits, and industrial equipment.

Referring to FIGS. 2A, 2B, 12, and 14, the present invention also includes a floating piston 34 for keeping the oil pressure within the bearing housing 16 about the same as the mud pressure in the annulus A, and a dipstick assembly 35 for measuring the oil level within the oil-sealed bearing pack assembly 100. As mentioned briefly above, the bearing housing 16 includes at least one upper radial bearing 32 generally situated near the flow restrictor 20 and the wear sleeve 42. Below the upper radial bearing 32 is the floating piston and dipstick assembly 35 which includes an oil reservoir 48 for supplying oil to the various bearings. In close proximity to the oil reservoir 48 is the thrust bearing assembly 40. Further, the bearing housing 16 includes at least one lower radial bearing 38 positioned below the thrust bearing assembly 40. All of the bearings, the grooves 54 of the cooled wear sleeves 42 and 43, and the oil reservoir 48 are in fluid communication. That is, the oil within the oil reservoir 48 can travel through passageways to reach all of the elements which require oil for cooling and lubricating.

In operation, the piston 34 applies pressure to the oil in reservoir 48 to keep the oil pressure within the cooled wear sleeves 42 and 43, the radial bearings 32 and 38, and the thrust bearing assembly 40 relatively the same as the mud pressure in the annulus A. To initially fill the bearing housing 16 with oil, a vacuum is applied through a hole 58 to drain the oil reservoir 48, the wear sleeves 42 and 43, and the bearings 32, 38, and 40 of air and oil. Oil is then introduced through the hole 58 and seeps through the lower radial bearing 38 into the thrust bearing assembly 40 and into the oil reservoir 48 and an annular passageway 46. The oil flows through the annular passageway 46 up to upper radial bearing 32 and into the wear sleeve 42. Also, the oil introduced through the hole 58 flows into the lower wear sleeve 43. Once the system is filled with oil, the piston 34 applies a constant pressure to the oil reservoir 48 to maintain oil within the bearing housing components.

Figure 12:
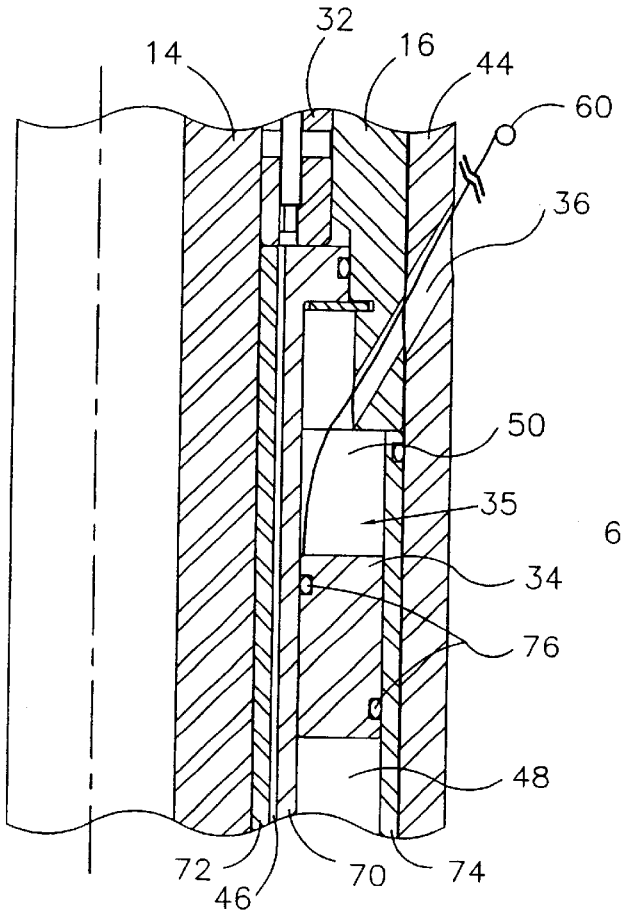
FIG. 12 is a fragmentary sectional view of the present invention showing a dipstick.

As shown in FIG. 12, the piston 34 is isolated from the rotating drive shaft by an inner reservoir liner 70. Thus, the piston 34 does not seal against a rotating surface. A rotating spacer 72 secures to the drive shaft 14 but does not contact the inner reservoir liner 70. Thus, the inner reservoir liner 70 and the rotating spacer 72 create the annular passageway 46 which permits oil to travel up to the radial bearing assembly 32 and the wear sleeve 42. An outer reservoir liner 74 secures to the stationary bearing housing 16 creating an outside wall for the oil reservoir 48.

During drilling operations, it is common for oil to leak slowly past the seals 30 and 31. As shown in FIG. 12, to monitor the oil within the bearing components, a dipstick 60 is inserted into dipstick conduit 36 which is bored through the bearing housing assembly 16 and the bearing cartridge 44. The dipstick 60 provides a method for determining the level of oil remaining in the oil reservoir 48.

In the present invention, during drilling mud enters into a mud reservoir 50 through dipstick conduit 36. The drilling mud within reservoir 50 provides a static pressure on the piston 34 causing the oil in the oil reservoir 48 to maintain the oil within the bearings and wear sleeves at the same relative pressure as the mud pressure in the annulus A. Further, the conduit 36 and the piston 34 provide a means for determining the oil level within oil reservoir 48. When the drilling motor is pulled from the drilled hole, the dipstick 60 can be inserted and removed from the conduit 36 to determine the amount of oil in the oil reservoir 48. The dipstick 60, however, measures the position of the piston 34 and from the position of the piston 34 it can be determined how much oil remains in oil the reservoir 48. As can be appreciated, the floating piston 34 and the dipstick assembly 35 could be constructed such that the oil reservoir 48 is above the piston 34 and the mud reservoir 50 is below it.

The dipstick 60 also serves the purpose of assuring that the oil reservoir 48 is filled to the proper level during assembly of the oil-sealed bearing pack assembly 100. Preferably, the oil reservoir 48 is not filled to capacity because the oil expands during operation. During operation and positioning of the downhole fluid motor M in the borehole H, the borehole temperature is greater than that where the sealed bearing pack assembly 100 was constructed and assembled. This greater temperature causes the oil in the oil reservoir 48 to expand. This expanding oil exerts pressure on the piston 34 causing it to move into the unfilled area of the oil reservoir 48. Without this unfilled area the expanding oil would exert excessive pressure on the seals 30 and 31, possibly causing them to be damaged. Elastomeric or O-ring seals 76 on the piston 34 prevent the mud in the reservoir 50 from seeping into the oil reservoir 48. The seals 76 are very effective in preventing the flow of oil and mud between the reservoirs 48 and 50 because the seals are not in contact with any rotating parts, such as the drive shaft 14 or the rotating spacer 72.

Referring to FIG. 13, an alternative piston 134 includes a check valve 62. As discussed above, during the operation of filling the oil-sealed bearing pack assembly 100, oil is injected into the hole 58. Often, however, difficulty can arise in getting the oil to flow up to the cooled wear sleeve 42 and the radial bearing 32 because the annular passageway 46 creates a greater back pressure than the oil reservoir 48. Thus, the piston 34 in the oil reservoir 48 reaches its preferred location prior to the oil reaching the cooled wear sleeve 42 and the radial bearing 32. Without oil traversing annular passageway 46, the bearing 32, and wear sleeve 42 would remain dry and seize within seconds of the commencement of drilling operations.

The check valve 62 in the piston 34 resolves the sometimes difficult task of filling the oil reservoir 48 and the annular passageway 46. In operation, the check valve 62 is set for a certain pressure such that the oil entering through the hole 58 will pressurize both the oil reservoir 48 and the annular passageway 46 to sufficiently provide oil to the upper radial bearing 32 and the cooled wear sleeve 42. When the pressure in the oil reservoir 48 reaches the set pressure of the check valve 62, oil will seep through the check valve 62 into the mud reservoir 50. The check valve 62 is set at a pressure sufficient to allow oil to flow up to radial bearing 32 and cooled wear sleeve 42. Additionally, the check valve 62 in the piston 34 allows the oil reservoir 48 to be completely filled with oil during assembly of the oil-sealed bearing pack assembly 100. When the static temperature rises in the borehole causing the oil to expand, the excessive pressure exerted by the oil causes the check valve 62 to open and release the excess pressure. This prevents the seals 30 and 31 from being damaged.

Figure 14:
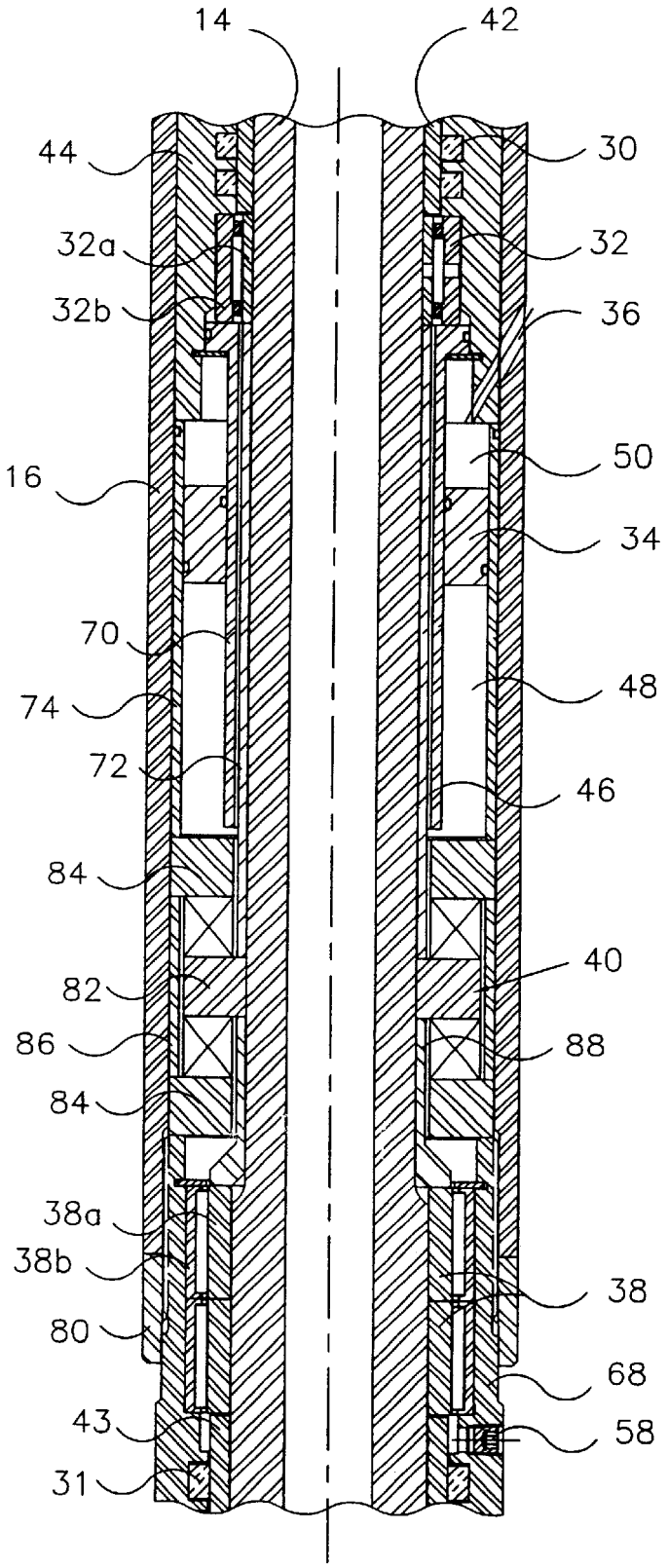
FIG. 14 is a fragmentary sectional view of a portion of the present invention.

Referring to FIGS. 2A and 14, the upper radial bearing 32 absorbs any side loads. The upper radial bearing 32 includes an inner radial bearing element 32*a* fixed to the rotating drive shaft 14. An outer radial bearing element 32*b* is fixed to the stationary bearing cartridge 44 as shown in FIG. 14. The lower radial bearing 38 also absorbs any side loads. The lower radial bearing 38 includes an inner radial bearing element 38*a* fixed to the drive shaft and an outer radial bearing element 38*b* fixed to the seal housing 68.

Referring to FIGS. 2B and 14, the seal housing 68 is threaded into the stationary bearing housing 16 and shoulders against the thrust bearing assembly 40. As shown in FIG. 14, the outer reservoir liner 74 is positioned between the upper end of the thrust bearing assembly 40 and the lower end of the bearing cartridge 44. The upper end of the bearing cartridge 44 bears against a lower flange 24*a* of the outer restrictive element 24 as shown in FIGS. 2A and 3. The lower seal housing 68 also functions as a compression sleeve in that it is in threaded engagement with the stationary bearing housing 16 such that rotation of the seal housing 68 relative to the bearing housing 16 beyond the point that all the clearances between components are taken up imparts a compressive preload to the stationary components of the bearing assembly 100.

Referring to FIGS. 2B and 14, a lock nut 80 is threaded to the seal housing 68 and shouldered to the stationary bearing housing 16 creating a frictional lock nut interface to ensure that the threaded connection does not loosen while in operation.

Referring to FIGS. 2A and 2B, a compression ring 18 is threadably connected to the drive shaft cap 12. The compression ring 18 shoulders against the upper end of the inner restrictive element 21. The inner restrictive element 21 shoulders against the upper cooled wear sleeve 42 which in turn is shouldered against the inner radial bearing element 32*a* (FIG. 14). The inner radial bearing element 32*a* is shouldered against the rotating spacer 72 which in turn is shouldered against the thrust bearing assembly 40 as described below. The inner lower portion of the thrust bearing assembly 40 is shouldered against the lower inner radial bearing elements 38*a*. The inner radial bearing element 38*a* is shouldered against the lower cooled wear sleeve 43. As shown in FIG. 8, the lower end of the cooled wear sleeve 43 is in sealing engagement with the enlarged lower end 14*a* of the drive shaft 14.

A compressive preload to the rotating elements of the bearing assembly 100 can be imposed by rotating the compression ring 18 relative to the drive shaft cap 12 such that any axial clearances which might exist between the rotating components is eliminated. Once any clearance is eliminated, further relative motion of the compression ring 18 builds a compressive preload helping to ensure that the rotating components of the bearing assembly 100 remain in engagement with respect to each other despite the high shock loads experienced during operation. One such thrust bearing assembly is described in Assignee's U.S. Pat. No. 5,690,434 to Beshoory and incorporated by reference.

It is to be understood that thrust bearing assemblies of various types may be used in accordance with the present invention. With reference to FIG. 14, the thrust bearing assembly 40 is shown having inner and outer thrust races 82 and 84, respectively. An outer bearing sleeve 86 is positioned between the pair of outer races 84. The inner race 82 is positioned between an inner bearing sleeve 88 and the rotating spacer 72. It is to be understood that the outer thrust bearing components 84 and 86 remain stationary with the bearing housing 16 whereas the inner thrust bearing components 82 and 88 are fixed to the drive shaft 14 and thus rotate with the drive shaft 14.

The foregoing disclosure and description of the invention are illustrative and explanatory thereof, and various changes in the details of the illustrated apparatus and construction and method of operation may be made without departing from the spirit of the invention.

What is claimed is:

1. In a downhole oil-sealed bearing pack assembly having a rotatable drive shaft extending therethrough, the improvement comprising:

a stationary bearing housing through which the drive shaft extends;

a chamber for containing oil in an annular space between said bearing housing and the drive shaft, said chamber extending upwardly to an upper seal and downwardly to a lower seal;

an upper bearing assembly in fluid communication with said chamber;

an upper wear sleeve fitted onto the drive shaft, said upper wear sleeve having an internal surface with a groove for receiving oil, said groove in fluid communication with said chamber;

a lower bearing in fluid communication with said chamber;

a lower wear sleeve fitted onto the drive shaft, said lower wear sleeve having an internal surface with a groove which is in fluid communication with said lower bearing; and a non-contact flow restrictor for reducing the pressure differential across said upper and lower seals.

2. In a downhole oil-sealed bearing pack assembly having a rotatable drive shaft extending therethrough, the improvement comprising:

a bearing housing;

a first sleeve positioned near the top of said bearing housing having a plurality of first rings traversing the length of said first sleeve, wherein each ring is separated from an adjacent ring by a first land; and a second sleeve positioned a distance apart from said first sleeve, wherein one of said sleeves is secured to the drive shaft and the other said sleeve is attached to a stationary bearing housing of the oil-sealed bearing pack assembly, said distance permitting a fluid to traverse said rings and lands.

3. The bearing pack assembly according to claim 2, wherein said second sleeve includes a plurality of second rings traversing the length of said second sleeve, each ring being separated by a second land, said second rings being positioned opposite said first lands.

4. The bearing pack assembly according to claim 3, wherein said second sleeve is a noncontiguous sleeve comprised of individual rings and lands.

5. The bearing pack assembly according to claim 2, wherein said first sleeve is a noncontiguous sleeve comprised of individual rings and lands.

6. The bearing pack assembly according to claim 2, wherein said bearing housing includes a radial bearing.

7. The bearing pack assembly according to claim 2, wherein said bearing housing includes a thrust bearing.

8. The bearing pack assembly according to claim 2, wherein said bearing housing includes an oil reservoir.

9. In a downhole oil-sealed bearing pack assembly having a rotatable drive shaft extending therethrough, the improvement comprising:

a first sleeve having a plurality of first rings traversing the length of said first sleeve, wherein each ring is separated from an adjacent ring by a first land; and a second sleeve positioned a distance apart from said first sleeve, wherein one of said sleeves is secured to the drive shaft and the other said sleeve is attached to a stationary bearing housing of the oil-sealed bearing pack assembly, said distance permitting a fluid to traverse said rings and lands, wherein said distance between said rings of said first sleeve and said second sleeve is greater at the top of said first sleeve than at the bottom of said first sleeve.

10. The bearing pack assembly according to claim 9, wherein said distance between said rings of said first sleeve and said second sleeve is about 0.012 inches at the top of said first sleeve.

11. The bearing pack assembly according to claim 9, wherein said distance between said rings of said first sleeve and said second sleeve is about 0.007 inches at the bottom of said first sleeve.

12. In a downhole oil-sealed bearing pack assembly having a rotatable drive shaft extending therethrough, the improvement comprising:

a hollow sleeve secured to the rotatable drive shaft, said hollow sleeve having an internal and an external surface;

a seal in contact with said external surface of said hollow sleeve;

a cooling fluid for dissipating heat generated by said seal contacting said external surface; and a groove cut into said internal surface for receiving said fluid.

13. The bearing pack assembly according to claim 12, wherein said hollow sleeve is interference fitted onto the drive shaft.

14. The bearing pack assembly according to claim 12, wherein said cooling fluid is a lubricant.

15. The bearing pack assembly according to claim 12, wherein a portion of said external surface is in fluid communication with a drilling fluid.

16. The bearing pack assembly according to claim 12, further comprising a reservoir for supplying said fluid to said groove.

17. The bearing pack assembly according to claim 16, wherein a portion of said external surface comprises a wall of said reservoir.

18. The bearing pack assembly according to claim 12, wherein said hollow sleeve is made of a material with higher heat conducting properties than said seal.

19. The bearing pack assembly according to claim 12, wherein said hollow sleeve includes a cooling upset for conducting away heat generated by said seal contacting said first surface.

20. The bearing pack assembly according to claim 12, wherein said hollow sleeve includes a cooling fin.

21. The bearing pack assembly according to claim 20, wherein said cooling fin is introduced into said reservoir.

22. A cooled wear sleeve assembly for extending the useful life of a rotatable shaft and a seal in contact with the drive shaft, the assembly comprising:

a sleeve having a first and a second surface;

a cooling fluid for dissipating heat generated by said seal contacting said first surface; and a groove cut into said second surface for receiving said fluid.

23. The cooled wear sleeve assembly according to claim 22, wherein said cooling fluid is a lubricant.

24. The cooled wear sleeve assembly according to claim 22, wherein said sleeve is made of a material with higher heat conducting properties than said seal.

25. The cooled wear sleeve assembly according to claim 22, wherein said sleeve includes a cooling upset for conducting away heat generated by said seal contacting said first surface.

26. The cooled wear sleeve assembly according to claim 22, wherein said sleeve includes a cooling fin for conducting away heat generated by said seal contacting said first surface.

27. In a downhole oil-sealed bearing pack assembly having a rotatable drive shaft extending therethrough, the improvement comprising:

a chamber for containing oil in an annular space between a bearing housing and the drive shaft of the bearing pack assembly;

a floating piston having a first side for applying pressure to the oil contained within said chamber and a second side for contacting a volume of drilling fluid in a reservoir;

a conduit extending through the bearing housing into said reservoir for supplying the drilling fluid into said reservoir; and a dipstick for insertion into said conduit for measuring the height of said piston within said chamber.

28. The oil-sealed bearing pack assembly according to claim 27, wherein an outer surface of said floating piston includes a seal to prevent the drilling fluid from seeping into said chamber.

29. In a downhole oil-sealed bearing pack assembly having a rotatable drive shaft extending therethrough, the improvement comprising:

a chamber for containing oil in an annular space between a bearing housing and the drive shaft of the bearing pack assembly;

a passageway extending from said chamber for allowing oil to enter said chamber;

a floating piston for applying pressure to the oil contained within said chamber, said piston having a first side and a second side; and a check valve contained within said piston for permitting fluid communication between said first and second sides of said piston when an oil pressure is reached within said chamber.

30. The bearing pack assembly according to claim 29, further comprising:

a reservoir on said second side of said piston for receiving a fluid;

a conduit extending into said reservoir for supplying the fluid to said reservoir; and a dipstick for insertion into said conduit for measuring the height of said piston within said chamber.

31. A piston assembly for maintaining constant oil pressure within a bearing housing, the piston assembly comprising:

a chamber for containing oil;

a floating piston having a first side for applying pressure to the oil contained within said chamber and a second side for contacting a volume of fluid in a reservoir;

a conduit extending into said reservoir for supplying the fluid into said reservoir; and a passageway from said chamber to the bearing housing.

32. The piston assembly according to claim 31, further comprising a dipstick for insertion into said conduit for measuring the height of said floating piston within said chamber.

33. The piston assembly according to claim 31, wherein said floating piston includes a check valve for permitting oil to flow from said chamber to said reservoir when an oil pressure is reached within said chamber.

34. The piston assembly according to claim 31, wherein an outer surface of said floating piston includes a seal to prevent the fluid of said reservoir from seeping into said chamber.

* * * * *